United States Patent [19]

Cronenwett et al.

[11] Patent Number: 4,603,529

[45] Date of Patent: Aug. 5, 1986

[54] ROOFING SYSTEM

[76] Inventors: Duane Cronenwett; Robert W. Gottfried, both of 911 N. Railroad Ave., West Palm Beach, Fla. 33401

[21] Appl. No.: 605,848

[22] Filed: May 1, 1984

[51] Int. Cl.[4] ..... E04B 1/00

[52] U.S. Cl. ..... 52/536; 52/519; 52/595

[58] Field of Search ..... 52/536, 539, 519, 535, 52/595

[56] References Cited

U.S. PATENT DOCUMENTS

| | | | |
|---|---|---|---|
| 954,520 | 4/1910 | Kester | 52/536 |
| 2,208,184 | 7/1940 | Fernandez | 52/536 |
| 3,309,831 | 3/1967 | Misch et al. | 52/519 |
| 3,866,378 | 2/1975 | Kessler | 52/536 |
| 4,279,106 | 7/1981 | Gleason et al. | 52/536 |

FOREIGN PATENT DOCUMENTS

| | | | |
|---|---|---|---|
| 903998 | 8/1962 | United Kingdom | 52/536 |

*Primary Examiner*—J. Karl Bell

*Attorney, Agent, or Firm*—Leonard Bloom

[57] ABSTRACT

Roof system including a plurality of shingled generally wedge shaped roof members. Each roof member has a long rectangular shape with tile markings on the upper forward surface. The generally wedge shaped roof members include a relatively planar upper surface except for an upward projecting flange that leans forward toward the forward side of the roof member. The lower surface includes a first converging planer lower surface portion extending beyond the position of the upper flange of a shingled lower roof member. The lower surface includes a second converging planer lower surface portion that ends in a rear edge. A border area between the first portion and the second portion is of increased thickness. A mating flange groove is located in the first portion which is arranged and sized to mate over the upper flange and rear portion of a lower shingled roof member.

14 Claims, 3 Drawing Figures

ROOFING SYSTEM

BACKGROUND OF THE INVENTION

The present invention is a roof system providing a long rectangular roof member having a generally wedge shaped cross section with a shingled interlock system that are butted up against the short side of an adjacent roof member with felt material beneath the butted joints.

In the past roofing systems included complicated structures having side and top-bottom interlocking members. Such systems have been either too costly or have failed to keep water from penetrating the roof systems.

SUMMARY OF THE INVENTION

A shingled roof system that includes a generally long rectangular roof member with a generally wedge shaped cross section. The longer sides are positioned generally parallel to the lower horizontal edge of the roof structure. The roof members require felt beneath the joints of each butted short side. The roof members are shingled over the roof structure by placement on the roof structure with the thick-long front portion below the thin long rear edge. The upper surface of the roof member may include cosmetic serrations to present a tile appearance. Also the cosmetic appearance of a bahama roof, bermuda roof, wood cedar thick butt shingles, barrel tiles, or oriental ceramic tiles may be molded into the design of the roof members. The roof members may also include fire retardent, weather resistant, ultra violet, fungus and mildew resistent finish such as an elastomeric membrane around the body of polyurethane foam.

The upper rear surface of a lower roof member butts up against the adjacent lower forward surface of the upper roof member. Adhesive is used between the butted short sides. Felt may be placed beneath each butt joint to direct water flowing down the roof onto the next lower roof member in the shingled array of roof members in the roof system.

The generally wedge shaped member in cross section includes two sections or portions, the first thicker wedge shaped portion and a second thinner wedge shaped portion. The first portion has a generally thick front edge with surfaces that taper to an intermediate thicker section or portion. The intermediate portion is the base of the second portion that has upper and lower surfaces that taper to a relatively thin upper or rear edge. The upper surface is generally in a single plane except for an upward and forward projecting flange. The flange mates with a mating flange groove in the forward portion of the lower surface of the next upper shingled roof member (and with a relatively snug fit therebetween). The flange and flange groove in each roof member extend substantially horizontally the length of the long side of each roof member. The lower surface of the roof member includes two portions. Each portion has a lower surface that is generally in a single plane. Each portion begins with a relatively thick forward end that tapers to a thinner upper or rear area. A border area lies between the first and second portions. The boarder area is thicker portion of the roof member. The roof members are shingled on top of one another with the thinner upper area positioned nearer to the peak of a roof.

It is an object of this invention to provide a low cost roof system that allows a roofing structure to be covered quickly.

It is another object of this invention to provide a non-complex interlocking system for retarding left of the lower or front edge of the roof members during high winds.

It is another object of this invention to provide a non-complex interlocking system for shedding water effeciently down a roof system.

A further object of this invention is to provide a system that requires adhesive in the butted areas of the roof members and may use felt in only certain butted areas of the roof member.

In accordance with these and other objects which will be apparent hereinafter, the instant invention will now be described with particular reference to the accompanying drawings.

DESCRIPTION OF THE PREFERRED EMBODIMENT

Figures 1, 2, 3:
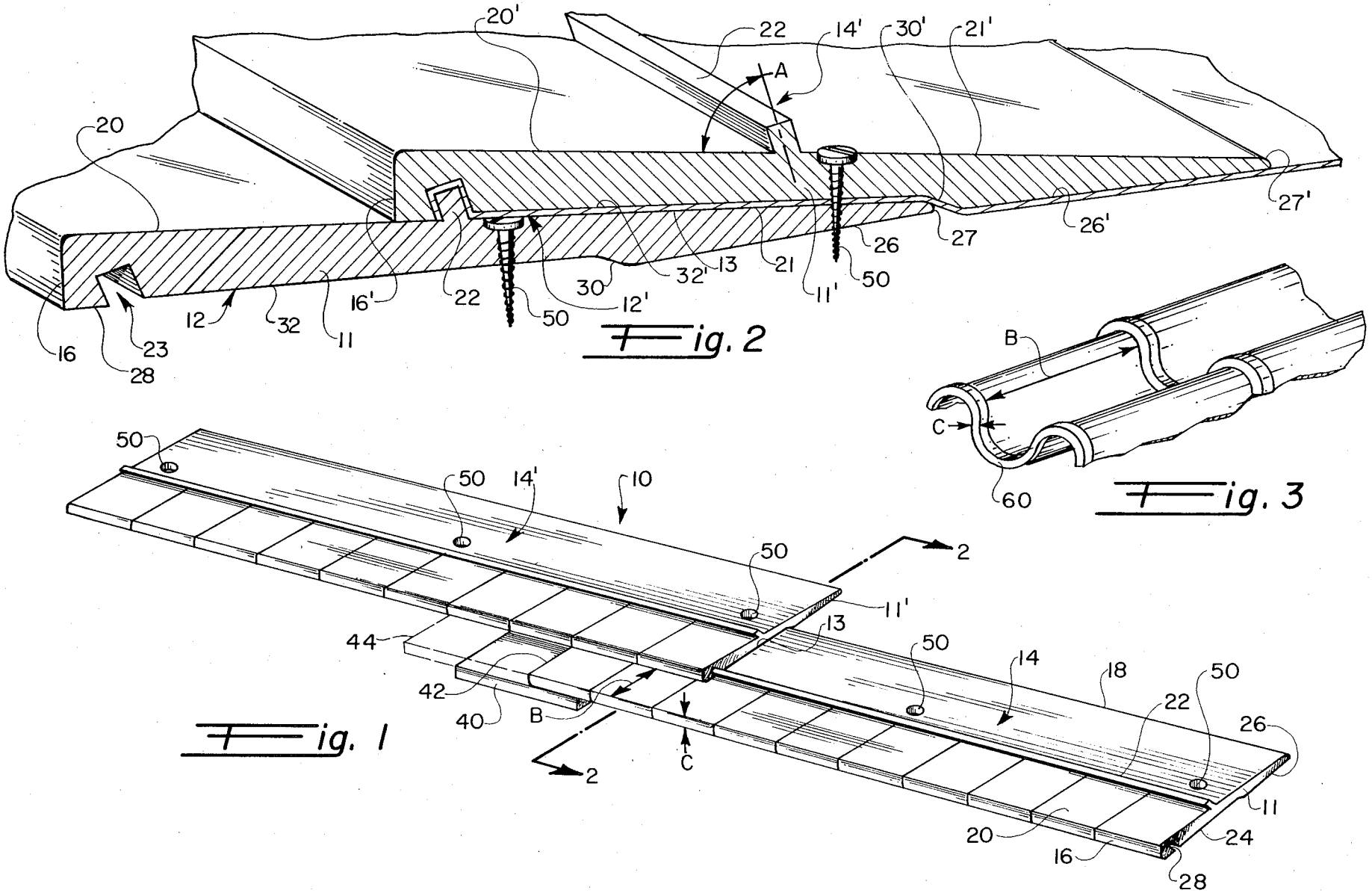
FIG. 1 is an isometric view of a shingled portion of the roofing system with an abutted roof memer in phantom.
FIG. 2 is a cross sectional view of the roof members in FIG. 1 taken along line 2—2 and looking in the direction of the arrows.
FIG. 3 is another embodiment.

Referring now to the drawing and FIGS. 1 and 2, the roof system 10 includes a plurality of shingled generally wedge shaped roof members 11 and 11'. Each roof member has a long rectangular shape with tile markings in the forward portion of surface 20 and felt 13 may be used between the shingled portions shown at 21 and 32' of the adjacent roof members 11 and 11' in FIG. 2.

The generally wedge shaped roof members 11 and 11' include a relatively large lower side 32, 30 and 26 on member 11 and 32', 30' and 26' on member 11' with a slot 23 in each member the slot runs the length of each member. The roof members 11 and 11' also include a planar upper surface 20 and 21 on member 11 and 20' and 21' on member 11' except for an upward projecting flanges 22 and 22' respectively that lean toward the thicker front edges 16 and 16'.

Each generally wedge shaped member in a cross section view includes two sections or portions, the first thicker wedge shaped portion and a second thinner wedge shaped portion. The first portion includes a flange 22 and a flange groove 23. The center line of each flange 22 is at an angle of approximately 20 degrees to the upper surface 20 and is preferrably at an angle of 20 degrees. The mating flange groove 23 is set to receive the next lower shingled flange (with a relatively snug fit therebetween) as illustrated in FIG. 1. The upper surfaces 14 and 14' including the surface 21 and 21' and flanges 22 and 22' are covered by the next upper shingled roof member. In this manner, the succeeding roof members substantially overlap one another (as shown more clearly in FIG. 2 of the drawings).

The lower surface of the first thicker wedge shaped member has a first converging planer lower surface portion extending from the front edge 16 to a position beyond the position of the flange groove 23. The lower surface of the second thinner wedge shaped member has a second converging planer lower surface portion to the rear edge 27 or 27'. The rear edge may be relatively sharp as shown at 18 in FIG. 1. A border area between the first portion and the second portion has an area of increased thickness at 30 or 30'. The lower surface of the first portion is constructed and arranged to mate over a lower roof member as illustrated in FIG. 2. The mating flange groove 23 is located in the first portion which is arranged and sized to mate over an upper flange as shown at 22 and rear portion 21' of the upper surface of the roof members shown in FIGS. 1 and 2.

The present invention therefore is a roof system 10 providing a generally wedge shaped rectangular roof member 11 and 11' with a shingled interlock system generally illustrated by numeral 12' in FIG. 2. The lower side 32' is shingled over top side 21. A felt strip 13 may be positioned below the butted joing 42 in FIG. 1 as shown in FIG. 2. Connecting fasteners 50 such as nails or screws may be used as illustrated in FIGS. 1 and 2 to hold the roof members in a shingled-butted position on a roof. The felt is preferrably placed over the nails. The shingled roof system that includes long rectangular roof member with the long edge positioned along a generally horizontal line on the roof of a building. The upper surface of the roof member along surface 20 and 20' forward of the flange 22 and 22' may include cosmetic serrations to present a tile appearance. The cosmetic appearance of a bahama roof, bermuda roof, wood cedar thick butt shingles, barrel tiles, or oriental ceramic tiles may be molded into the design of the roof members along the top surface of the first portion as shown at "B" but not interfering with the lower forward portion 28 of the above shingled roof member in front of the flange groove. Also the wedge shaped member is shown in FIGS. 1 and 2 in a flat configuration but it may be in a woven form or sine wave shape 60 along the longitudinal length of the horizontal edge to provide the barrel tile shape as shown in FIG. 3. The surface design of areas B and C may be changed to provide various roof textures and collars such as wood, cedar or slate.

The body or membrane surface of the roof members, which coats all surfaces of the body of the roof member, will also include various fire retardent, weather resistant, ultra violet and fungus and mildew resistent finish.

Adhesive is placed between the butt joints. Felt strips 13 are preferably placed beneath each butt joint as shown in FIG. 2 to direct water flowing down the roof onto the next lower roof member. The felt strips 13 may be used at the butt joints 42 in addition to adhesive. The felt strips have a side length as shown in FIG. 2 and a front length of approximately one foot. Further, felt may also be placed in strips as illustrated at 40 beneath the butting side edges 42 of roof members or in addition, although not necessary felt may be used along the entire roof structure beneath the shingled roof members. In FIG. 1 the next adjacent roof member 44 is shown in dashed lines to illustrate the side edge abuttment of roof members 44 and 11.

Each roof member is preferrably constructed of lightweight polyurethane foam body. Applied to all surfaces is a membrane coating illustrated by the single line around the cross hatched body 11 and 11' in FIG. 2. A membrane is applied to all surfaces to create a weathertight seal and to provide ultraviolet, fungus and mildew protection. Well known ultraviolet, fungus and mildew materials are combined with the membrane. This membrane will be an Elastomeric waterproof coating manufactured from a modified synthetic polymer applied at the time of manufacture of the foam body. The particular type of material to be used on a roof member may be varied by recoating the roof member at a later date.

An adhesive is used at each butt joint shown at 42 in FIG. 1 to create a weather-tight joint and to act as an expansion joint. The butt joint lies between the two adjacent roof members illustrated at numeral 42. The adhesive will be applied by using caulking type methods as the roof is applied. The adhesives may also be used along the entire length of each flange 22. The adhesive must be used along the butt joints such as numeral 42 illustrating an adjacent roof member in phantom.

The roof members are connected to one another and the roof by nails as shown or other fasteners 50. The nails may be placed at the location of the fasteners 50 shown in FIGS. 1 and 2. Large headed type fasteners long enough to penetrate well into the sub-strate of the roof are preferrable. The large headed nail shall are rust resistant. Each roof member will have location marks such as identical surface areas in the roof member as shown to position the nail head below the plane of the surface 21 and 21' or indicia showing proper places to be nailed.

The flange preferrably has a sloping upper surface having a width greater than the forward height. The spacing from the front 16 is relatively short as shown at 28.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A roof system comprising:

roof members having mateable bodies in a shingled array on a sloping roof structure, each said roof member having a rectangular shape in plan view with longer sides positionable along a horizontal line on the sloping roof structure, said longer sides including a thin rear side and a thick forward side, each said roof member having two sections, said two sections constituting a first section and a second section, said first and second sections each being generally wedge shaped and having a thicker forward portion opposite a thinner rear portion, each said roof member further including an intermediate connecting section that is thicker than adjacent sections, each said roof member having a generally planar upper surface except for an upward projecting flange running substantially horizontally of the length of said longer side, said flange projecting upwardly from the intermediate section of each roof member, each said roof member having a lower surface including a first generally planar portion in said thicker forward portion and a second generally planar portion in said thinner rear portion, said lower surface including a mating flange groove running substantially horizontally for mating with an upward projecting flange on a lower roof member with a relatively snug fit therebetween, wherein the roof members are substantially overlapped with respect to each other and include an upper roof member and a lower roof member, and wherein the first section of a lower roof member is received substantially beneath the second section of succeeding upper roof member.

2. A roof system as set forth in claim 1, wherein:
said flange leaning forward in said thicker forward portion to aid in negating wind lifting said thicker forward portion of upper roof member.

3. A roof system as set forth in claim 2, wherein:
said flange is generally at a 20 degree angle to said upper surface.

4. A roof system as set forth in claim 3, including:
each said roof member having a short side abutting an adjacent short side, and adhesive between abutting short sides.

5. A roof system as set forth in claim 4, including:
felt positioned between and beneath abutting lower surfaces of adjacent said thicker forward portions of adjacent roof members and on top of the upper surface of said thinner rear portion of a lower roof member.

6. A roof system as set forth in claim 5, wherein:
each said roof member has longer sides over five times the length of said short sides.

7. A roof system as set forth in claim 5, wherein:
said roof members have longer sides over eight times the length of said short sides.

8. A roof system as set forth in claim 3, wherein:
said roof member includes a tile design, and
said roof member includes flame retardant, weather resistant, ultra violet and fungus and mildew resistant materials.

9. A roof system as set forth in claim 3, wherein:
said body having a lightweight polyurethane and coated with an elastomeric water-proof coating.

10. In a roofing system, wherein a plurality of roof members are arranged to nest with respect to each other, the improvement which comprises a plurality of overlapping roof members constituting at least an upper roof member and a lower roof member, each of the roof members having a pair of generally wedge-shaped sections including a first section and a second section joined by an intermediate section, wherein the first section of the lower roof member is received substantially beneath the second section of the upper roof member, the intermediate section of the lower roof member having an upwardly-projecting flange formed thereon, and the second section of the upper roof member including a generally thickened forward portion having a bottom surface formed with a groove therein, wherein the flange on the lower roof member is received within the groove on the upper roof member with a relatively snug fit therebetween.

11. The improvement of claim 10, wherein each of the roof members has a substantially rectangular plan outline, and wherein the cooperating flanges and grooves run substantially horizontally relative to the roof.

12. The improvement of claim 10, wherein the roof members are substantially identical.

13. The improvement of claim 10, wherein the second section of each roof member has an upper surface provided with a design.

14. In a roofing system, wherein a plurality of roof members are arranged to nest with respect to each other, the improvement which comprises a plurality of overlapping substantially-identical roof members having a generally rectangular plan outline and constituting at least an upper roof member and a lower roof member, each of the roof members having a pair of generally wedge-shaped sections including a first section and a second section joined by an intermediate section, wherein the first section of the lower roof member is received substantially beneath the second section of the upper roof member, wherein the second section of each roof member has an upper surface provided with a design, the intermediate section of the lower roof member having an upwardly-projecting flange formed thereon, the second section of the upper roof member including a generally thickened forward portion having a bottom surface formed with a groove therein, wherein the flange on the lower roof member is received within the groove on the upper roof member with a relatively snug fit therebetween, and wherein the cooperating flanges and grooves run substantially horizontally relative to the roof.

* * * * *